US011413487B2

(12) United States Patent
Hidalgo

(10) Patent No.: US 11,413,487 B2
(45) Date of Patent: Aug. 16, 2022

(54) MODULAR PROTECTIVE PAD SYSTEM

(71) Applicant: Matthew Hidalgo, Portland, OR (US)

(72) Inventor: Matthew Hidalgo, Portland, OR (US)

( * ) Notice: Subject to any disclaimer, the term of this patent is extended or adjusted under 35 U.S.C. 154(b) by 0 days.

(21) Appl. No.: 17/112,687

(22) Filed: Dec. 4, 2020

(65) Prior Publication Data

US 2022/0176182 A1 Jun. 9, 2022

(51) Int. Cl.
*A63B 6/02* (2006.01)
*A63B 71/00* (2006.01)

(52) U.S. Cl.
CPC ..... *A63B 6/02* (2013.01); *A63B 71/0054* (2013.01); *A63B 2225/09* (2013.01)

(58) Field of Classification Search
CPC ... A63B 6/02; A63B 2225/09; A63B 71/0054; A63B 6/00; A47C 27/00; A47C 27/122; A47C 27/001
See application file for complete search history.

(56) References Cited

U.S. PATENT DOCUMENTS 5,964,634 A * 10/1999 Chang ..... A47C 13/005 446/111
6,964,246 B2 * 11/2005 Wolfington ..... A01K 1/035 119/847
10,688,331 B1 * 6/2020 Strawderman ..... A63B 5/06
2016/0220030 A1 * 8/2016 Chenfu ..... A47C 27/00

* cited by examiner

*Primary Examiner* — Andrew S Lo
*Assistant Examiner* — Andrew M Kobylarz
(74) *Attorney, Agent, or Firm* — Alleman Hall Creasman & Tuttle LLP

(57) ABSTRACT

A modular protective pad system includes a plurality of modular pad units that can be secured to each other in a variety of configurations in two or three-dimensions using a set of removable patches that selectively engage with touch fasteners of the modular pad units. Example configurations include side-by-side, face-to-face, and folded/semi-folded configurations, as well as any suitable combination of these configurations.

20 Claims, 8 Drawing Sheets

MODULAR PROTECTIVE PAD SYSTEM

BACKGROUND

Sports such as un-roped rock climbing and gymnastics utilize fall protection pads on ground surfaces and around hazardous objects to reduce injury to athletes. The sport of bouldering, for example, features the use of backpackable fall protection pads commonly referred to as crash pads that can be carried into a bouldering area and utilized around boulders to provide protection for climbers.

SUMMARY

According to an example, a modular protective pad system, includes a plurality of modular pad units. The modular protective pad system can provide a variety of configurations of modular pad units in two dimensions or three dimensions, including side-by-side, face-to-face, and folded/semi-folded configurations, and any suitable combination of these configurations. Each modular pad unit forms a three-dimensional volume having two rectangular broad faces that oppose each other, and a plurality of exterior edge faces that join the two rectangular broad faces to each other along a perimeter of the modular pad unit. A first face of the two rectangular broad faces includes a plurality of broad-face touch fasteners each of which forms a two-dimensional region of the first face along a portion of the perimeter of the modular pad unit. Two or more of the plurality of exterior edge faces each include an edge-face touch fastener that forms a two-dimensional region of that exterior edge face along a portion of the perimeter. The modular protective pad system further includes a set of one, two or more removable patches which each include a patch-based touch fastener that forms a two-dimensional region that is configured to selectively engage with any of the broad-face touch fasteners and the edge-face touch fasteners of the plurality of modular pad units, enabling the units to be selectively secured to each other.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Figure 1A:
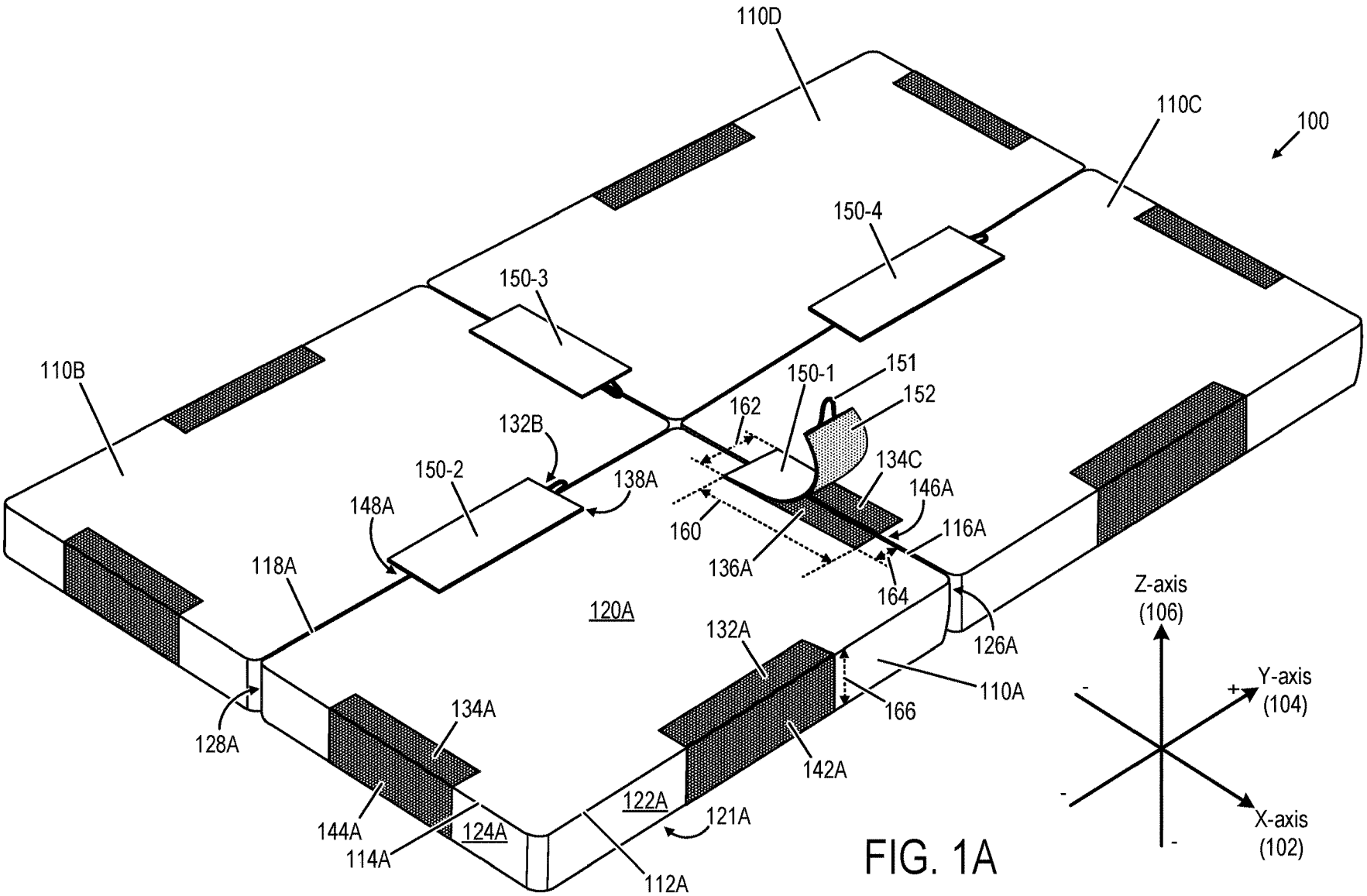
FIGS. 1A and 1B show aspects of an example modular protective pad system.

A modular protective pad system is disclosed that includes a plurality of modular pad units that can be secured to each other using a set of one, two, or more removable patches that selectively engage with touch fasteners of the modular pad units. These touch fasteners can include or otherwise form a hook-side or a loop-side of a hook-and-loop fastener. The modular protective pad system can provide a variety of configurations of modular pad units in two or three dimensions, including side-by-side, face-to-face, and folded/semi-folded configurations, and any suitable combination of these configurations. By utilization of touch fasteners and removable patches, each pad is granted 360 degrees of independent modular connectivity at each face or plane surface.

As an example, the side-by-side configuration of modular pad units can be provided by use of a removable patch that joins a face of a modular pad unit to a face of another modular pad unit. This side-by-side configuration can be used to cover a ground surface, wall surface, etc. using any suitable quantity of pads.

As another example, a face-to-face configuration of modular pad units can be provided between the broad faces of the units by use of a removable patch that joins a side of a modular pad unit to a side of another modular pad unit. Two or more sides of a modular pad unit can be joined to two or more sides of another modular pad unit (e.g., on opposing sides of the pad units) using respective removable patches to retain or reinforce the face-to-face configuration. This face-to-face configuration can be used to stack and secure two or more modular pad units to increase overall pad depth or to transport the modular units.

As yet another example, a folded/semi-folded configuration of modular pad units can be provided by use of removable patch that joins a side of a modular pad unit to a side of another modular pad unit, enabling the two modular pad units to be rotated relative to each other to any suitable angle. This folded/semi-folded configuration can be used, for example, to conform the modular protective pad system to other objects, such as trees, boulders, structures, etc.

Any combination of the side-by-side, face-to-face, and/or folded/semi-folded configurations can be provided using three or more modular pad units that are joined to each other using a plurality of removable patches, thereby providing users with flexibility in configuring the modular protective pad system with respect to a variety of use environments and pad transportation scenarios. Face-to-face and side-by-side connection of modular units can be configured and secured (together) in the same multi-unit system, allowing for three-dimensional (connective) modularity (adding to the height, width, or depth of the system). Unit to unit connectivity can be made on any corresponding face between the units, at every positive and negative axis point corresponding to applicable faces of any multi-faced three-dimensional volume/unit, in at least some examples.

Figure 1B:
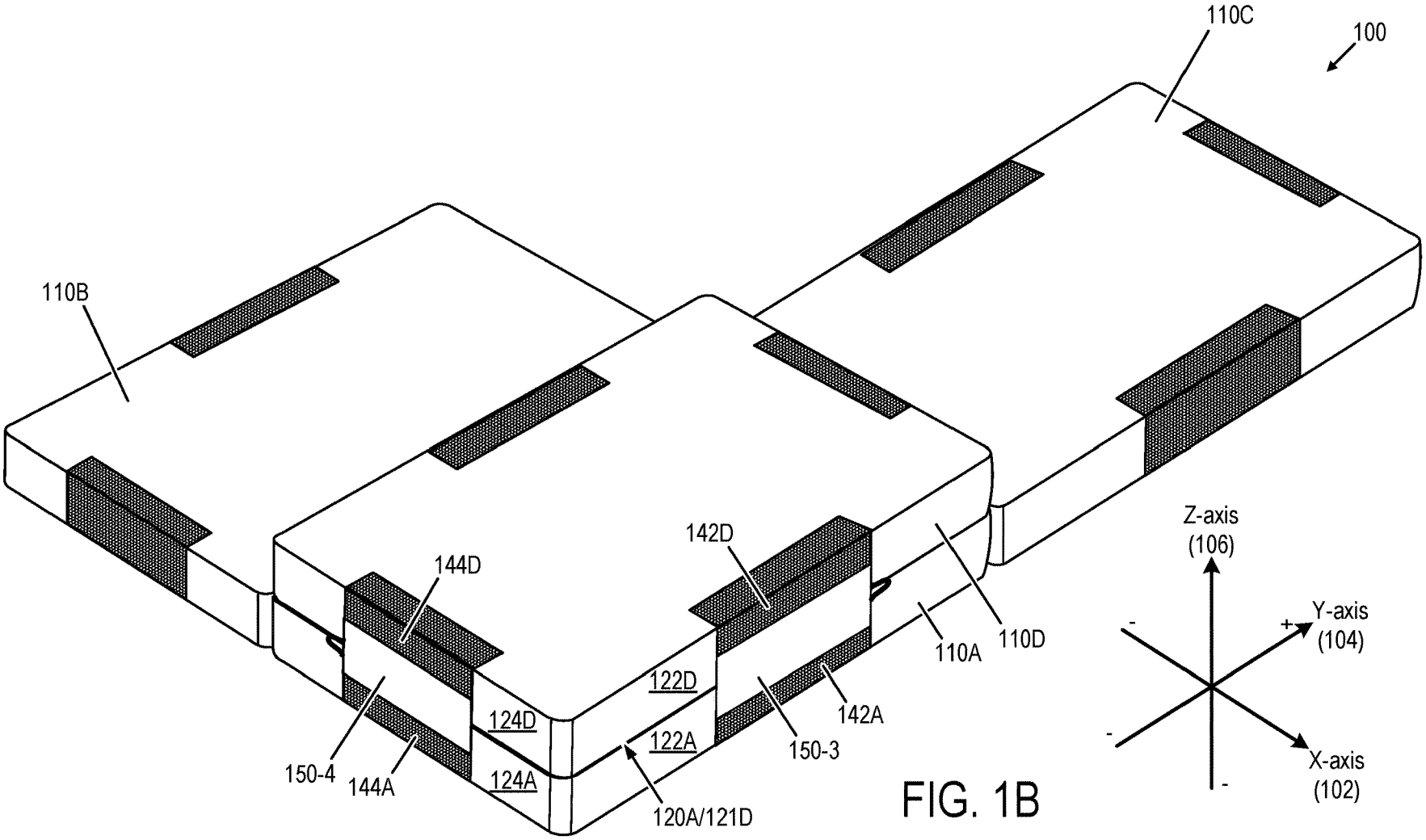

FIGS. 1A and 1B shows aspects of an example modular protective pad system 100 that includes a plurality of modular pad units. In this example, system 100 includes four modular pad units 110A, 110B, 110C, and 110D. An example reference frame formed by an X-axis 102, a Y-axis 104, and a Z-axis 106 is provided in FIGS. 1A and 1B for purposes of discussion. In FIG. 1A, modular pad units 110A, 110B, 110C, and 110D are arranged in a side-by-side configuration that provides a larger, combined protective pad along a ground surface (e.g., the X-Y plane in FIG. 1A).

In FIG. 1B, modular pad units 110A, 110B, and 110C are arranged in a side-by-side configuration similar to FIG. 1A, while modular pad unit 110D is arranged in a face-to-face configuration with modular pad unit 110A between the broad faces of the units (e.g., 120A of unit 110A and 121D of unit 110D) that increases a pad depth (e.g., relative to the ground surface along the Z-axis in FIG. 1B). While system 100 includes four modular pad units in this example, system 100 can include any suitable quantity of modular pad units, such as two, three, five, dozens, or more modular pad units.

Each of the modular pad units of system 100 can be similarly configured in at least some examples, such as depicted in FIGS. 1A and 1B. Thus, additional features of the modular pad units are described with respect to example modular pad unit 110A. Accordingly, features described with respect to modular pad unit 110A can be similarly present on or with respect to each of the modular pad units of system 100.

In this example, each modular pad unit of system 100 forms a three-dimensional volume having two rectangular or generally rectangular broad faces that oppose each other, and a plurality of exterior edge faces that join the two rectangular broad faces to each other along a perimeter of the modular pad unit. For example, modular pad unit 110A includes rectangular or generally rectangular broad faces 120A and 121A that oppose each other, and a plurality of exterior edge faces 122A, 124A, 126A, and 128A that join the two rectangular broad faces 120A and 121A to each other along a perimeter of the modular pad unit indicated by perimeter portions 112A, 114A, 116A, and 118A. Thus, in this example, each modular pad unit forms a cuboid, as an example of a three-dimensional volume. In the example depicted in FIG. 1A, edge faces 122A and 128A represent longer edge faces as measured along a linear dimension of the perimeter as compared to edge faces 124A and 126A. In other examples, edge faces of the modular pad units can be of equivalent size as measured along a linear dimension of the perimeter to provide broad faces having a square or generally square shape.

A first or front face 120A of the two rectangular broad faces includes a plurality of broad-face touch fasteners 132A, 134A, 136A, and 138A. Each of these broad-face touch fasteners forms a two-dimensional region of face 120A along a portion of the perimeter of the modular pad unit. For example, touch fastener 132A can be located along a first perimeter portion representing some or all of perimeter portion 112A, touch fastener 134A can be located along a second perimeter portion representing some or all of perimeter portion 114A, touch fastener 136A can be located along a third perimeter portion representing some or all of perimeter portion 116A, and touch fastener 138A can be located along a fourth perimeter portion representing some or all of perimeter portion 118A. The various touch fasteners described herein can take the form of either a hook-side of a hook-and-loop fastener or a loop-side of a hood-and-loop fastener, as an example.

Furthermore, in this example, each of the plurality of exterior edge faces have a broad-face touch fastener that forms a two-dimensional region of that exterior edge face along a portion of the perimeter. For example, edge-face touch fastener 142A of exterior edge face 122A can be included along a first perimeter portion representing some or all of perimeter portion 112A, edge-face touch fastener 144A of exterior edge face 124A can be included along a second perimeter portion representing some or all of perimeter portion 114A, edge-face touch fastener 146A of exterior edge face 126A can be included along a third perimeter portion representing some or all of perimeter portion 116A, and edge-face touch fastener 148A of exterior edge face 128A can be included along a fourth perimeter portion representing some or all of perimeter portion 118A.

While FIG. 1A depicts the modular pad units including an edge-face touch fastener for each of four edge faces of the units, in other examples, only some of the edge faces of the modular pad units include an edge-face touch fastener. As an example, the modular pad units can include two broad-face touch fasteners on edge faces that are located on opposite sides of the broad faces of the units. As another example, the modular pad units can include three broad-face touch fasteners on three of four edge faces of the units.

System 100 includes a set of one or more removable patches 150 that can be selectively used to secure two of the modular pad units of system 100 to each other. Each removable patch 150 includes a patch-based touch fastener that forms a two-dimensional region that is configured to selectively engage with each or any of the broad-face touch fasteners (e.g., 132, 134, 136, 138, etc.) of any of the modular pad units, and with each or any of the edge-face touch fasteners (e.g., 142, 144, 146, 148, etc.) of any of the modular pad units.

An example instance of the removable patch is shown at 150-1 in FIG. 1A with patch-based touch fastener 152 being partially removed from broad-face touch fastener 132A of unit 110A and from broad-face touch fastener 134C of unit 110C. Patch-based touch fastener 152 of each removable patch can be a different one of either a hook-side or a loop-side of a hook-and-loop fastener as compared to broad-face touch fasteners and edge-face touch fasteners of the units to enable the patches to be selectively used to secure two units to each other by engaging with either of broad-face touch fasteners and/or edge-face touch fasteners. In other words, patch-based touch fasteners of the removable patches 150 can each be hook-side or loop-side of hook-and-loop fasteners, whereas the modular pad unit-based touch fasteners can each be an opposite of the hook-side or loop-side of hook-and-loop fasteners as compared to the removable patches. Touch fasteners are described as utilizing hook-and-loop in several examples, it will be understood that other suitable types of touch fasters may be utilized that do not utilize hook-and-loop, such as those relying on removable adhesives static charge, interconnecting magnetics, etc.

In this example, removable patch 150-1 spans modular pad units 110A and 110C to secure the two modular pad units to each other along their edge faces via their respective broad-face touch fasteners 136A and 134C. Similarly, another example instance of the removable patch is shown at 150-2 that spans modular pad unit 110A and 110B to secure the two modular pad units to each other along their edge faces via their respective broad-face touch fasteners 138A and 132B. Still other example instances of the removable patch are shown at 150-3 to secure modular pad units 110B and 110D to each other along their edge faces, and at 150-4 to secure modular pad units 110C and 110D to each other along their edge faces.

In at least some examples, each instance of patch 150 can include a pull tab 151 that enables an edge of the patch to be more easily grasped, lifted, and peeled from touch fasteners of the modular pad units, thereby facilitating the partial separation or complete removal of the patches from the touch fasteners of the modular pad units as part of reconfiguring system 100. Within the example of FIG. 1A, pull tab 151 takes the form of a pull loop that projects outward from an edge of the patch. However, pull tab 151 can take other suitable forms. Pull tab 151 can be sewn or otherwise secured to patch 150 between patch-based touch fastener 152 forming a first layer and another material layer located on an opposing side of the patch, as one example configuration. While instances of pull tab 151 are depicted in FIGS. 1A and 1B, these pull tabs are omitted from other figures as examples of patches that do not include pull tabs.

In at least some examples, each instance of patch 150 can have a rectangular shape that has a length 160 in a linear dimension that is equivalent or approximately equivalent to a length of each broad-face touch fastener in a linear dimension as measured along the perimeter of the unit. Length 160 of patch 150 can be larger than a width 162 of the patch as measured in a linear dimension orthogonal to length 160. FIG. 1A depicts an example in which length 160 represents the linear dimension of both the patches and the broad-face touch fasteners, as being only part of the length of the perimeter portions of the units. In other examples, length 160 can be up to a length of the shortest perimeter portion of the units, thereby enabling patch 150 to be used along any side of the unit to secure that unit to another unit. In still further examples, two different types of removable patches can be included with system 100 in which a longer removable patch representing the longest dimension of the unit is used along a longer perimeter portion of the units and a shorter removable patch representing the shorter dimension of the unit is used along a shorter perimeter portion. However, a potential disadvantage of this approach is that the longer removable patch may not be usable along all sides of the unit, such as with respect to the shorter perimeter portion. By contrast, removable patches that are equivalent or similar size and shape can be used interchangeable along any of the perimeter portions of the units.

In at least some examples, each broad-face touch fastener of the modular pad units can extend from and border a corner formed between the broad face and an exterior edge face of the unit along a portion of the perimeter. As depicted in FIG. 1A, for example, broad-face touch fastener 136A borders the corner formed between broad face 120A and exterior edge face 126A, and extends inwards from the corner by a distance 164 in a linear dimension as measured orthogonal to exterior edge face 126A. Broad-face touch fastener 134C in this example extends an equivalent distance as 164 in an opposite direction from its respective edge face and an interface between units 110A and 110C. In at least some examples, each broad-face touch fastener of each unit can extend an equivalent distance 164 inward from an exterior corner of that unit and can have an equivalent length dimension 160.

Furthermore, in the example depicted in FIG. 1A, patch 150 has a linear dimension that is twice the size or approximately twice the size of the distance that the broad-face touch fasteners extend into the interior of the broad face of each unit from the exterior corner. For example, instance 150-1 has a linear dimension 162 that is twice the size of distance 164 (or at least twice the size with some additional width to account for a small gap between the units), thereby enabling the patch to cover the broad-face touch fasteners of neighboring units. However, in at least some examples, the broad-face touch fasteners may not extend entirely to the corner of the unit. In such cases, the distance of linear dimension 162 of the patch can be at least twice that of distance 164 as measured from an exterior edge face of each modular pad unit. At minimum, the shortest linear dimension (e.g., width 162) of the two-dimensional region formed by each of the patch-based touch fasteners is larger than twice a distance measured in a linear dimension from each broad-face fastener to the perimeter portion along which that broad-face fastener is located, thereby enabling the removable patch to be secured between two broad-face touch fasteners of different modular pad units.

The modular pad units depicted in FIG. 1A include broad-face touch fasteners and edge-face touch fasteners at locations that are symmetrically located about each perimeter portion of the unit, thereby enabling touch fasteners of different units to be aligned with each other. Furthermore, in the example of FIG. 1A, edge-face touch fasteners have a width 166 as measured in a linear dimension that is approximately twice the width or distance 164 of the broad-face touch fasteners. In other words, broad-face touch fasteners can extend inwards from the exterior edge of the pad unit by approximately half the thickness of the pad unit between broad faces 120A and 121A. This configuration enables edge-face touch fasteners of two modular pad units to be joined by removable patch 150, as described in further detail with reference to FIGS. 2-4.

Referring also to FIG. 1B, modular pad unit 110D has be moved from the side-by-side configuration of FIG. 1A to the face-to-face configuration with modular pad unit 110A. FIG. 1B further shows an example in which removable patches 150-3 and 150-4 used in FIG. 1A to secure the face of modular pad unit 110D to the faces of modular pad units 110B and 110C, respectively, are instead used to secure edges 122D and 124D to edges 122A and 124A, respectively. Thus, the removable patches disclosed herein can be used to secure both faces and edges of the modular pad units to each other in a variety of different configurations.

Figure 2:
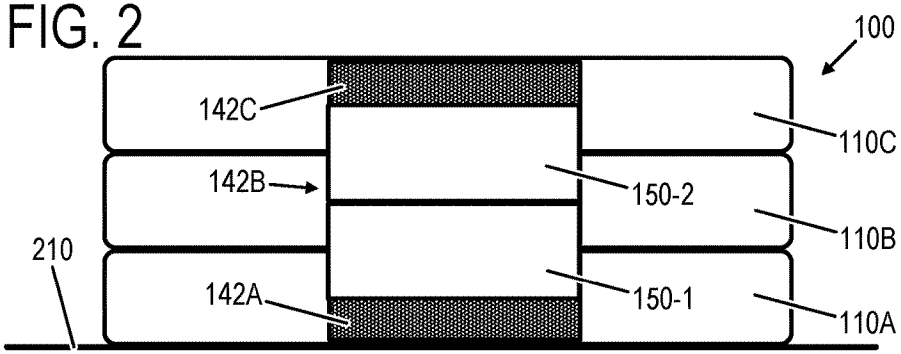
FIG. 2 shows additional aspects of the modular protective pad system of FIGS. 1A and 1B having a different configuration.

FIG. 2 shows aspects of modular protective pad system 100 again including a plurality of modular pad units. In this example, system 100 includes three modular pad units 110A, 110B, and 110C of FIGS. 1A and 1B arranged in a face-to-face configuration and resting upon a ground surface 210 to provide a combined protective pad having an increased thickness in a vertical dimension. The increased thickness of the configuration of FIG. 2 can provide users with additional protection for higher potential falls onto the pad or from hazardous objects located beneath the pads. In this example, instances 150-1 and 150-2 of patch 150 previously depicted in FIGS. 1A and 1B are instead used to secure modular pad unit 110A to unit 110B and unit 110B to unit 110C, respectively, by engaging with edge-face touch fasteners 142A, 142B, and 142C.

Figure 3:
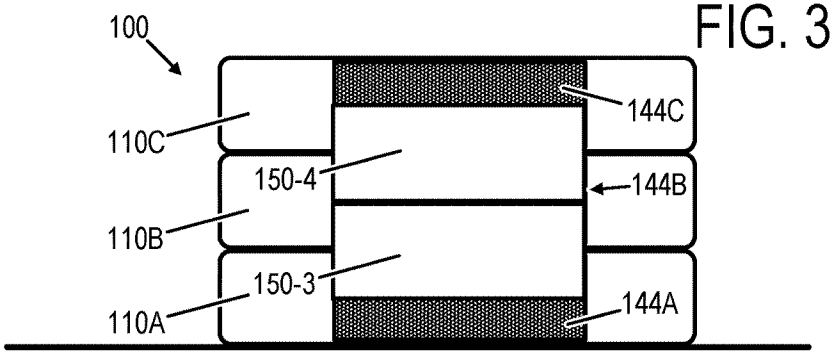
FIG. 3 shows additional aspects of the modular protective pad system in the configuration of FIG. 2 from a different side of the modular pad units.

FIG. 3 shows aspects of modular protective pad system 100 in the configuration of FIG. 2 from a different side of the modular pad units to show the use of additional removable patches to secure the modular pad units to each other. In this example, instances 150-3 and 150-4 of patch 150 are used to secure modular pad unit 110A to unit 110B and unit 110B to unit 110C, respectively, by engaging with edge-face touch fasteners 144A, 144B, and 144C.

It will be understood that opposite sides of the modular pad units can similarly use additional instances of removable patches 150 to secure 110A to unit 110B and unit 110B to unit 110C along each of the four exterior edges of the units. For example, to secure three units to each other in a face-to-face configuration on all four exterior edges of the units, a total of eight instances of patch 150 can be used. As another example, to secure two units to each other in a face-to-face configuration on all four exterior edges of the units, a total of four instances of patch 150 can be used. In still further examples, removable patches may be omitted from two opposing sides of the modular pad units in the face-to-face configuration. For example, removable patches can be used along edge faces 122A, 122B, and 122C as depicted in FIG. 2, and also used along opposing edge faces 128A, 128B, and 128C without using removable patches along the remaining two sides of the pad units. As yet another example, removable patches can be used along edge faces 124A, 124B, and 124C, and also used along opposing edge faces 126A, 126B, and 126C without using removable patches along the remaining two sides of the pad units. Thus, the removable patches in combination with the broad-face and edge-face touch fastener configurations disclosed herein provides users with numerous configurations and possibilities when joining two or more modular pad units.

Figure 4:
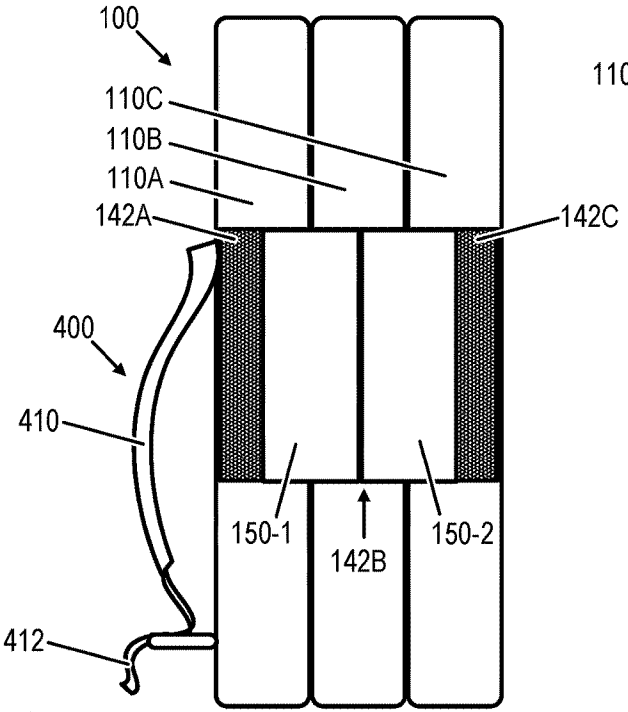
FIG. 4 shows additional aspects of the modular protective pad system in the configuration of FIGS. 2 and 3, but with the system being transported as a backpack through the use of a backpack strap system.

FIG. 4 shows aspects of modular protective pad system 100 in the face-to-face configuration of FIGS. 2 and 3, but with system 100 being transported as a backpack through the use of a backpack strap system 400 that can form part of system 100. Backpack strap system 400 can include a set of shoulder straps 410 and a waistbelt 412.

Figure 5:
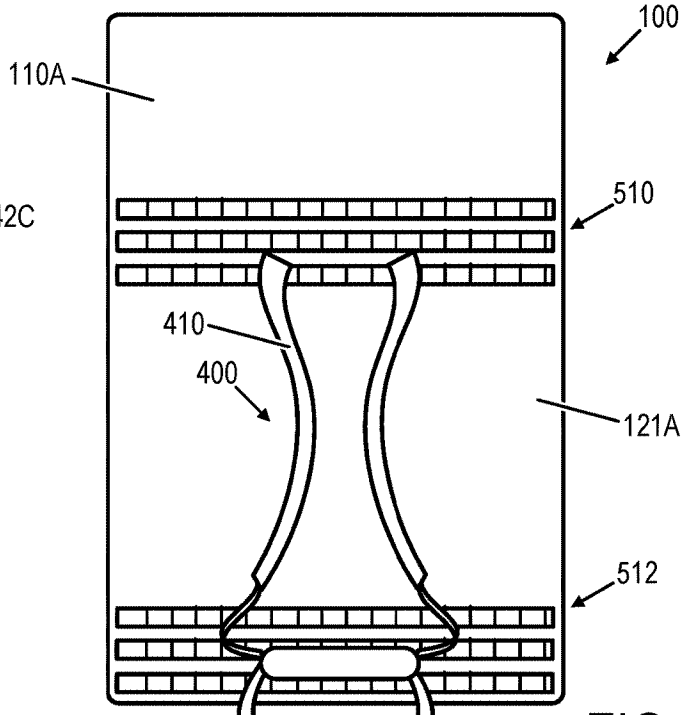
FIG. 5 shows additional aspects of the modular protective pad system in the configuration of FIG. 4 from perspective facing the second or rear face of the unit.

FIG. 5 shows aspects of modular protective pad system 100 in the configuration of FIG. 4 from perspective facing second or rear face 121A of unit 110A. In this example, attachment points in the form of upper daisy chain strips 510 and lower daisy chain strips 512 are provided on rear face 121A to which backpack strap system 400 can be permanently or removably secured to unit 110A. As an example, shoulder straps 410 and/or waistbelt 412 can utilize hook-and-loop, clips, snaps, buttons, laces, or other suitable fastener to secure the backpack strap system 400 to the upper and lower daisy chain strips, thereby enabling the backpack strap system 400 to be removed from the modular pad unit during use as a protective pad.

Figure 7:
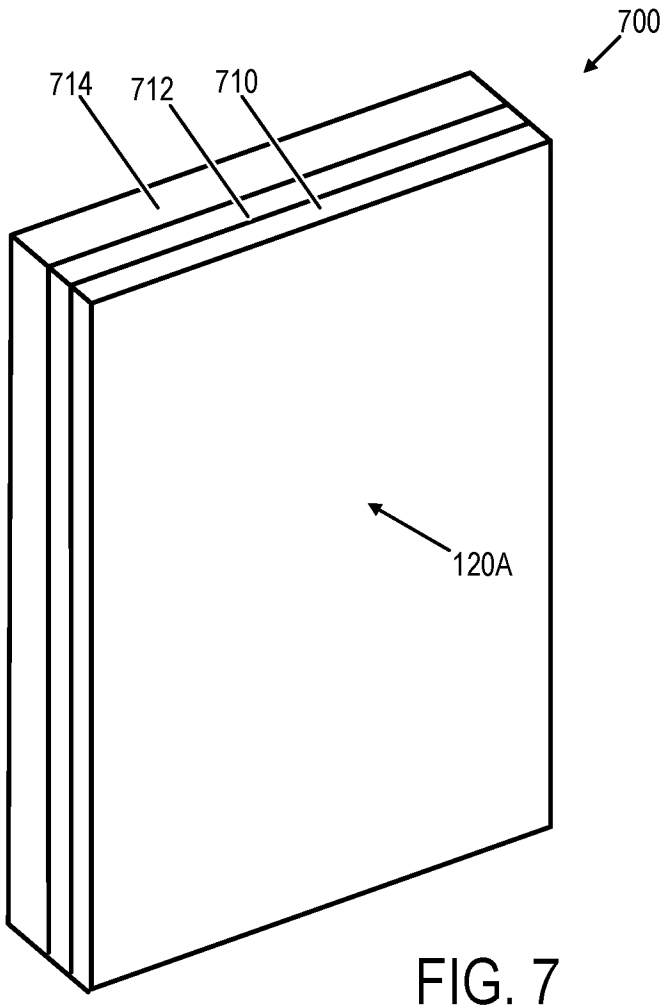
FIGS. 6 and 7 show additional aspects of the modular pad units relating construction of the units.
Figure 6:
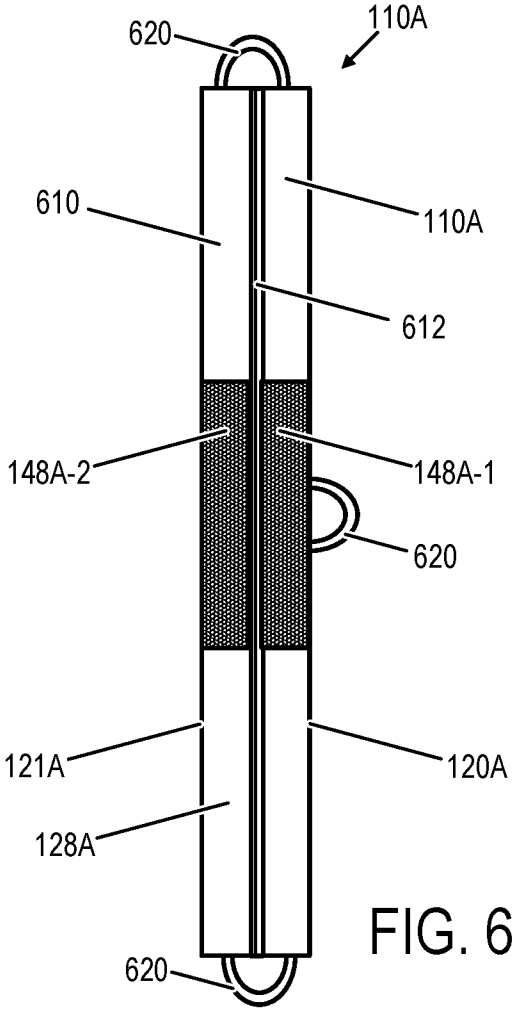

FIGS. 6 and 7 show additional aspects of a modular pad unit with reference to example modular pad unit 110A. Within FIG. 6, exterior edge face 128A is visible. Each modular pad unit may be formed by an exterior cover portion 610 that surrounds an interior portion 700, depicted in FIG. 7. Cover portion 610 can be formed from a natural, synthetic, or blended textile. Within FIG. 6, a zipper 612 is provided along exterior edge face 128A by which interior portion 700 can be added or removed from cover portion 610. However, zipper 612 can be replaced with one or more other suitable types of fasteners including hook-and-loop, buttons, snaps, buttons, laces, etc. In at least some examples, zipper 612 can bisect edge-face touch fasteners, such as touch-fastener 148A, into halves 148A-1 and 148A-2. The unit-based touch fasteners described herein can be sewn onto cover portion 610 in at least some examples. Furthermore, in at least some examples, the modular pad units can include one or more flexible handles 620 sewn to cover portion 610 that can be used to move or carry the unit.

FIG. 7 shows example interior portion 700 being formed from a plurality of layers, including an open cell foam layer 710 that is adjacent to broad face 120A, a closed cell foam layer 712, and an open cell foam layer 714 that is adjacent to broad face 121A. It will be understood that other suitable configurations may be used for interior portion 700.

Figure 8:
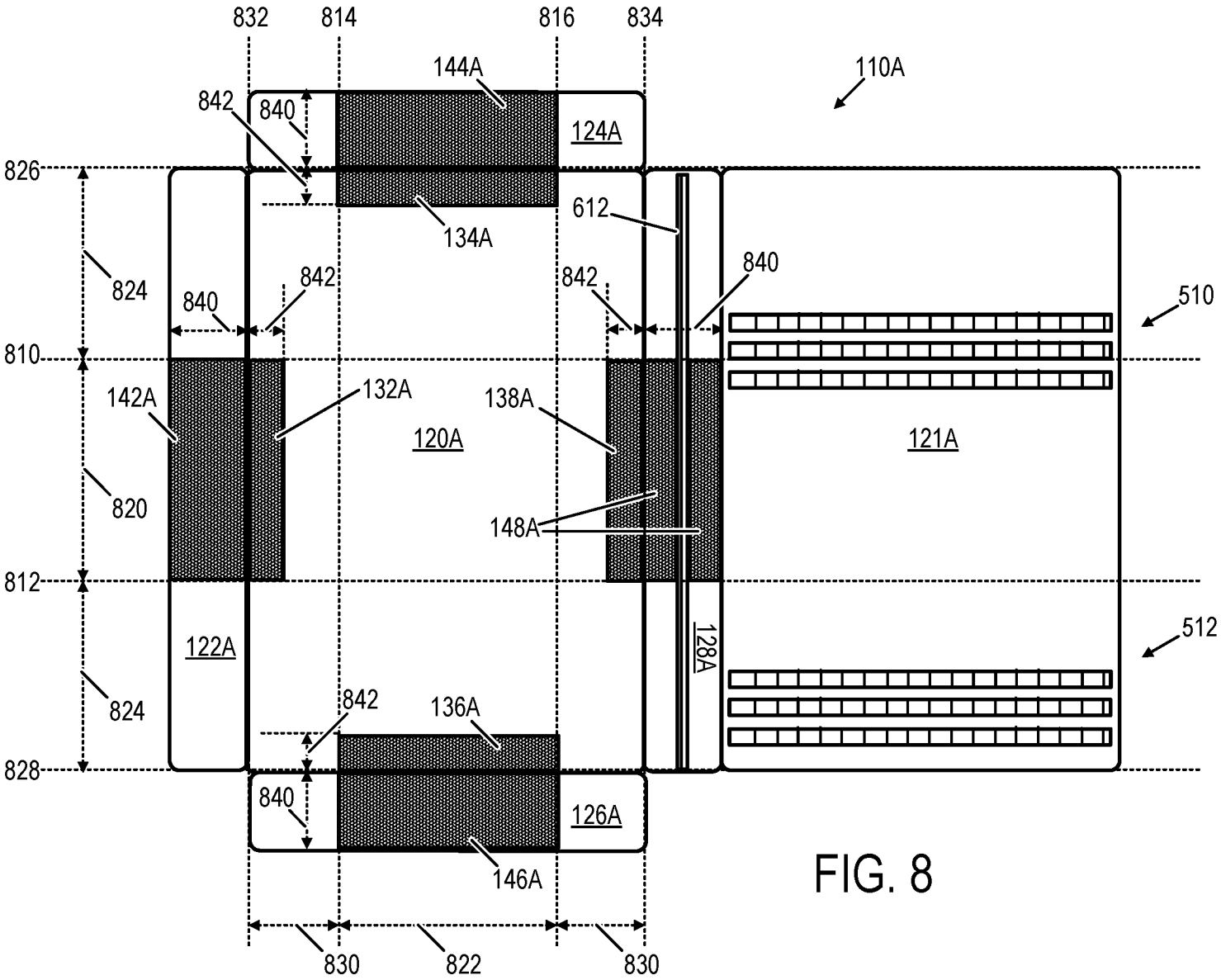
FIG. 8 shows cover portion 610 of FIG. 6 in a flattened view to show each of the unit-based touch fasteners of example unit 110A in a single view.

FIG. 8 shows cover portion 610 of FIG. 6 in a flattened view to show each of the unit-based touch fasteners of example unit 110A in a single view. Within FIG. 8, for each edge-face touch fastener, that edge-face touch fastener at least partially overlaps in a linear dimension with a broad-face touch fastener of the plurality of broad-face touch fasteners along the portion of the perimeter of the modular pad unit along which that broad-face fastener is located. More specifically, within FIG. 8, each edge-face touch fastener is aligned (e.g., the edges thereof) with one of the plurality of broad-face touch fasteners along a portion of the perimeter. A potential advantage of this configuration is to enable removable patches can be stored on-board the modular pad unit by wrapping around the corner of the pad until used to join two or more modular pad units. Additionally, aligning the broad-face touch fasteners with the edge-face touch fasteners along the perimeter of the unit allows any existing multi-pad systems to have one, or more pads added to the system along any applicable face by positioning adjustment or addition of removable patches.

FIG. 8 further shows example dimensions and alignment of features of a modular pad unit (e.g., 110A) of system 100. In this example, touch fasteners 142A, 132A, 138A, and 148A reside between reference datums 810 and 812; and touch fasteners 144A, 134A, 136A, and 146A reside between reference datums 814 and 816. Thus, in this example, touch fasteners 142A, 132A, 138A, and 148A are each aligned with each other between reference datums 810 and 812; and touch fasteners 144A, 134A, 136A, and 146A are aligned with each other between reference datums 814 and 816. For example, touch fasteners 142A, 132A, 138A, and 148A have a length dimension 820; and touch fasteners touch fasteners 144A, 134A, 136A, and 146A have a length dimension 822. Dimensions 820 and 822 are the same or approximately the same length in at least some examples. However, in other examples, dimensions 820 and 822 can have different lengths. For example, touch fasteners of a long edge of the unit can have a longer length dimension than touch fasteners of a short edge of the unit.

Additionally, in this example, reference datums 810 and 812 are each located at a distance 824 from a nearest external edge datum 826 or 828, respectively. Distance 824 can be referred to as an inset distance with respect to touch fasteners 142A, 132A, 138A, and 148A. Similarly, reference datums 814 and 816 are each located at a distance 830 from a nearest external edge datum 832 or 834, respectively. Distance 830 can be referred to as an inset distance with respect to touch fasteners 144A, 134A, 136A, and 146A. In this example, distance 830 differs from (e.g., is less than) distance 824. However, in other examples, distances 830 and 832 can be the same or approximately the same.

Within FIG. 8, a width dimension 840 of each of edge-face touch fasteners 142A, 144A, 146A, and 148A are shown; and a width dimension 842 of each of broad-face touch fasteners 132A, 134A, 136A, and 138A are shown. In this example, width dimension 842 is equal to or approximately one-half of width dimension 840. However, touch fasteners can have other suitable configurations. As previously described with reference to FIGS. 1A and 1B, removable patches can have the same or approximately the same dimensions as the edge-face touch fasteners, and can have approximately twice the width of broad-face touch fasteners, in at least some examples.

Figure 9:
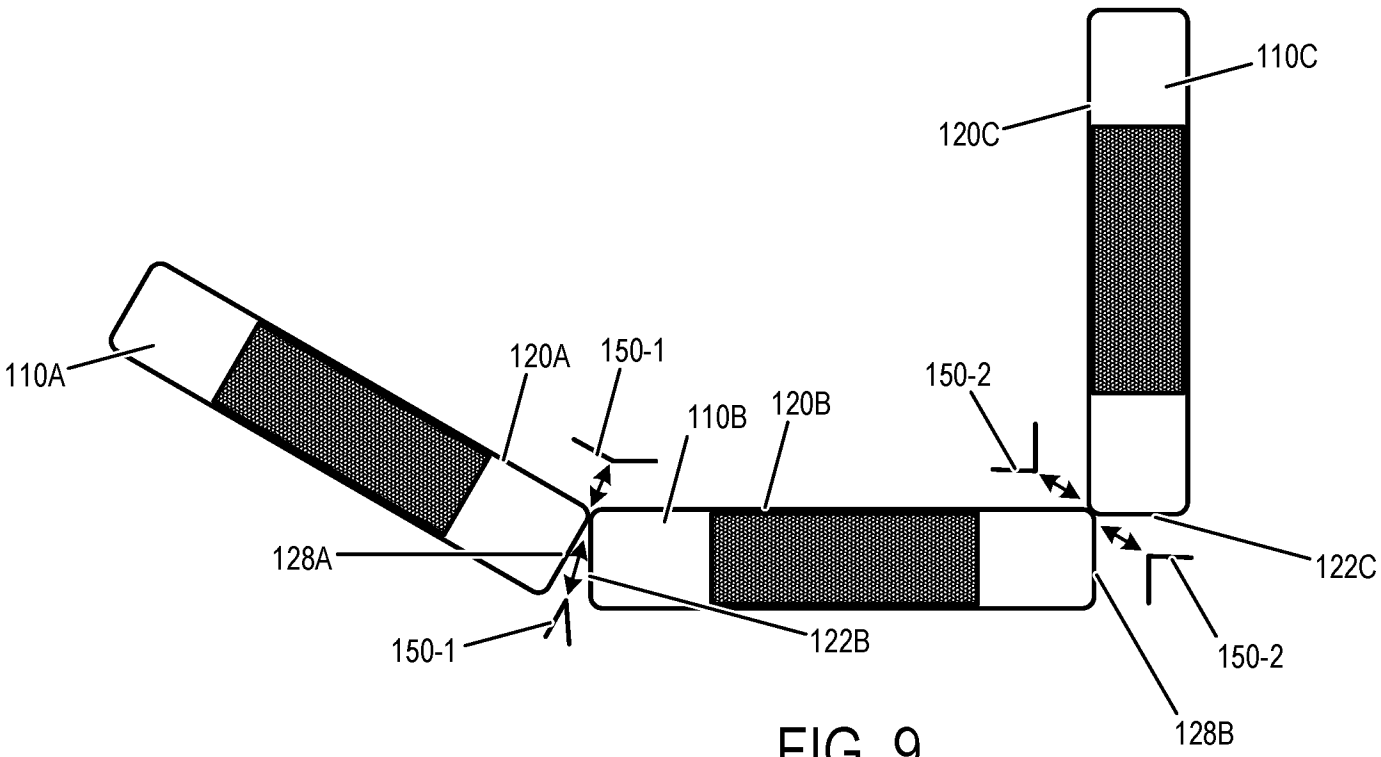
FIG. 9 shows additional aspects of the modular protective pad system of FIGS. 1A and 1B having a different configuration.

FIG. 9 shows additional aspects of modular protective pad system 100 of FIGS. 1A and 1B having a different configuration. In this example, modular pad units 110A and 110C each have a folded/semi-folded configuration with respect to modular pad unit 110B. For example, modular pad unit 110A can be joined to modular pad unit 110B along either the broad faces of the units (e.g., 120A and 120B) or the edge faces of the units (e.g., 128A and 122B) by removable patch 150-1. As another example, modular pad unit 110C can be joined to modular pad unit 110B along either the broad faces of the units (e.g., 120C and 120B) or the edge faces (e.g., 128B and 122C) of the units (e.g., 128B and 122C) by removable patch 150-2. Instances of the removable patch 150 described herein can be flexible, enabling a center bend placed along an interface between the two modular pad units provide for up to 180 degrees of hinge travel when connecting broad faces or edge faces of two units. As an example, instances of removable patch 150 can be formed by a textile or other flexible material to which hook-and-loop or other touch fastener is mounted. In at least some examples, two instances of removable patch 150 can be provided on either side of the hinge axis between two modular pad units to reduce or inhibit rotation of the units relative to each other or to cover gaps between units. For example, modular pad unit 110A can be joined to modular pad unit 110B along both the broad faces of the units (e.g., 120A and 120B) and the edge faces of the units (e.g., 128A and 122B) by removable patches as shown in FIG. 9 with reference to removable patch 150-1.

FIGS. 10-13 shows aspects of additional example modular protective pad systems in which modular pad units are joined by removal patches using additional patch securing techniques. It will be understood that the examples depicted or described with respect to FIGS. 10-13 can be similarly used or incorporated into previously described modular protective pad system 100 of FIGS. 1A and 1B.

Figure 10:
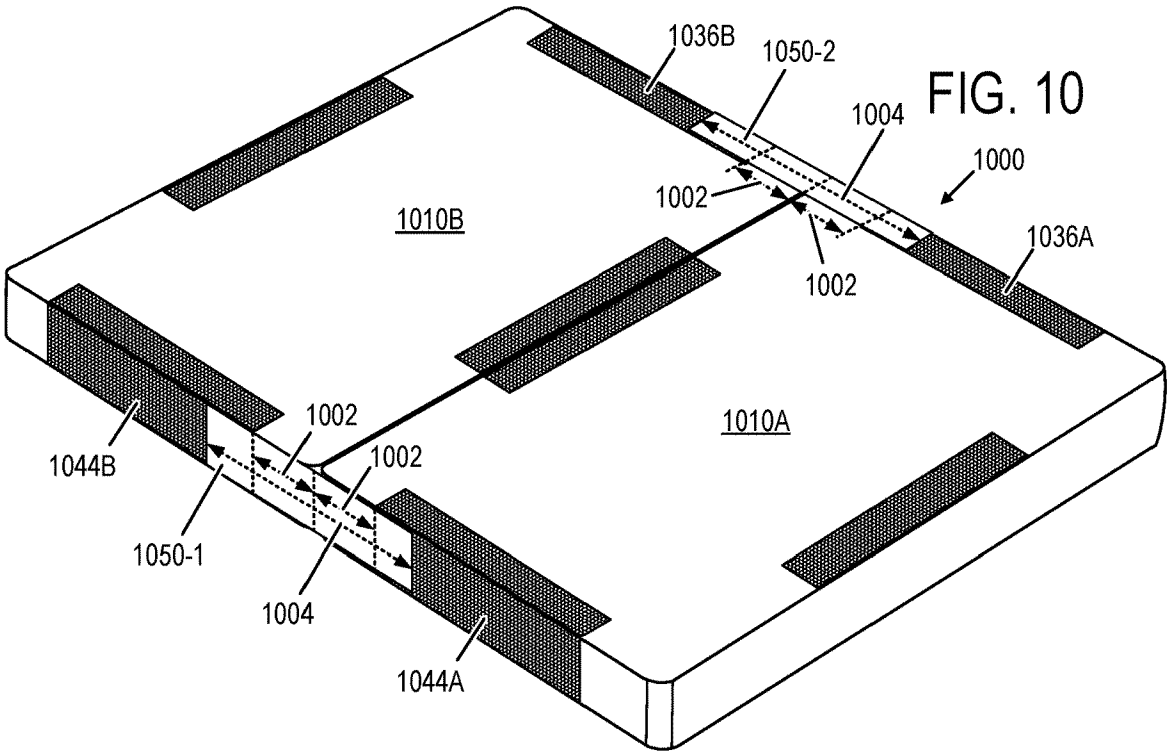
FIGS. 10-13 shows aspects of additional example modular protective pad systems in which modular pad units are joined by removal patches using additional patch securing techniques.

FIG. 10 shows another example modular protective pad system 1000 consistent with the present disclosure. In this example, a first modular pad unit 1010A is secured to a second modular pad unit 1010B by a first removable patch 1050-1 that spans edge-face touch fastener 1044A and edge-face touch fastener 1044B of the units. Removable patches 1050-1 and 1050-2 each similarly include a touch fastener as previously described with reference to removable patches 150 of FIGS. 1A and 1B. Edge-face touch fasteners of system 1000, including 1044A and 1044B, extend along the edge faces to a distance dimension 1002 (i.e., an inset distance) from the nearest corner or neighboring edge face that forms an interface between the units, and removable patches 1050-1 and 1050-2 have a length dimension 1004 that is greater than twice the distance dimension 1002 to enable the removable patches to span the interface between the two units while engaging with the edge-face touch fasteners (e.g., 1044A and 1044B).

Additionally, in this example, first modular pad unit 1010A is secured to second modular pad unit 1010B by a second removable patch 1050-2 that spans broad-face touch fastener 1036A and broad-face touch fastener 1036B of the units. Within FIG. 10, second removable patch 1050-2 is also secured to edge-face touch fasteners located on an opposite side of the units from edge-face touch fasteners 1044A and 1044B. Similarly, in this example, broad-face touch fasteners of system 1000, including 1036A and 1036B, extend along the broad faces to a distance dimension 1002 from a corner or edge face that forms the interface between the units, and removable patches 1050-1 and 1050-2 have a length dimension 1004 that is greater than twice the distance dimension 1002 to enable the removable patches to span the interface between the two units while engaging with the broad-face touch fasteners (e.g., 1036A and 1036B).

Figure 11:
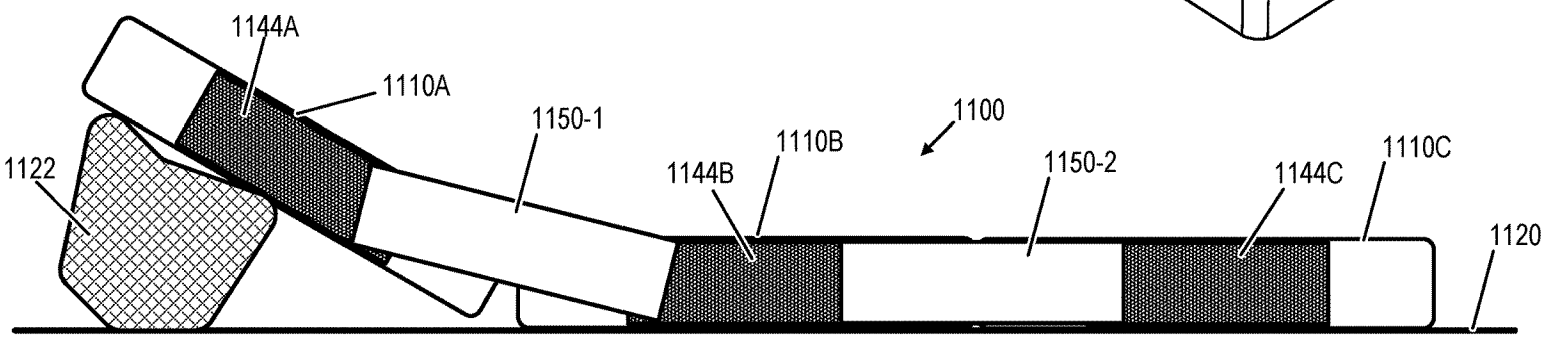

FIG. 11 shows another example modular protective pad system 1100 consistent with the present disclosure. In this example, modular pad units 1110A and 1110C are each secured to modular pad unit 1110B using removable patches 1150-1 and 1150-2, respectively. Removable patches 1150-1 and 1150-2 each similarly include a touch fastener as previously described with reference to removable patches 150 of FIGS. 1A and 1B. Removable patch 1150-1 secures units 1110A and 1110B to each other via edge-face touch fasteners 1144A and 1144B while units 1110A and 1110B are angled or folded/semi-folded relative to each other. Removable patch 1150-1 in this example can reduce or inhibit rotation of unit 1110A relative to unit 1110By by interfacing with edge-face touch fasteners 1144A and 1144B. This configuration may provide greater resistance to rotation of the units relative to each other as compared to the configuration described with reference to FIG. 9. Removable patch 1150-2 secures units 1110B and 1110C to each other via edge-face touch fasteners 1144B and 1144C while units 1110B and 1110C are arranged side-by-side within the same plane. For example, system 1000 is depicted in relation to a ground surface 1120 upon which an object 1122 (e.g., a boulder) rests. Modular pad unit 1110A is angled relative to modular pad units 1110B and 1110C to cover object 1122 while modular pad units 1110B and 1110C cover a portion of ground surface 1120. A similar configuration as FIG. 11 can be achieved using system 1000 of FIG. 10 or the other systems described herein through the use of removable patches that interface with edge-face touch fasteners along an axis that is orthogonal to the hinge axis formed by the units.

Figure 12:
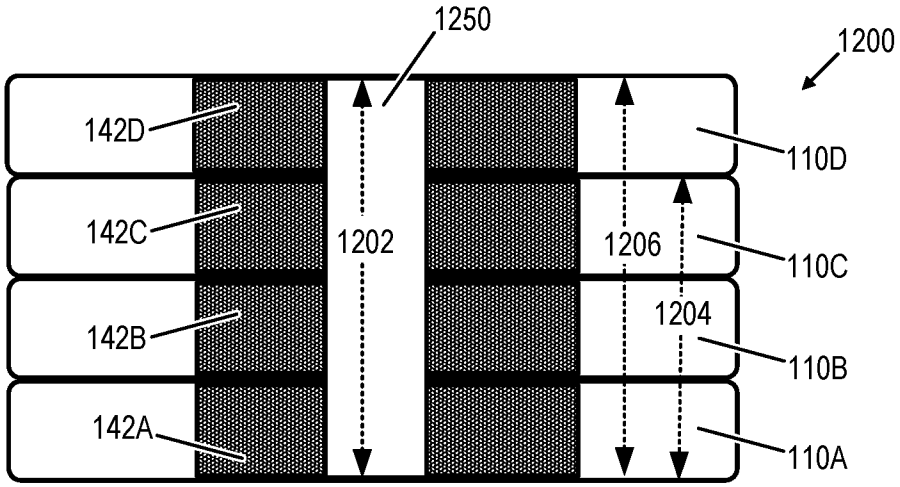

FIG. 12 shows another example modular protective pad system 1200 consistent with the present disclosure. In this example, system 1200 includes units 110A, 110B, 110C, and 110D previously described with reference to system 100 of FIGS. 1A and 1B. However, in this example, removable patches such as example patch 1250 can have a length dimension 1202 that is greater than a thickness 1204 of three units and/or approximately equal to a thickness 1206 of four units, thereby enabling four units to be stacked and secured in a face-to-face configuration with a single removable patch on one or more sides of the system. For example, a touch fastener of patch 1250 can interface with each of touch fasteners 142A, 142B, 142C, and 142C of the four units. In a further configuration, if pad unit 110D is removed, patch 1250 can be wrapped around a corner formed by a perimeter of pad unit 110C, and attach to a broad-face touch fastener of pad unit 110C, for example, to provide added connection strength.

Figure 13:
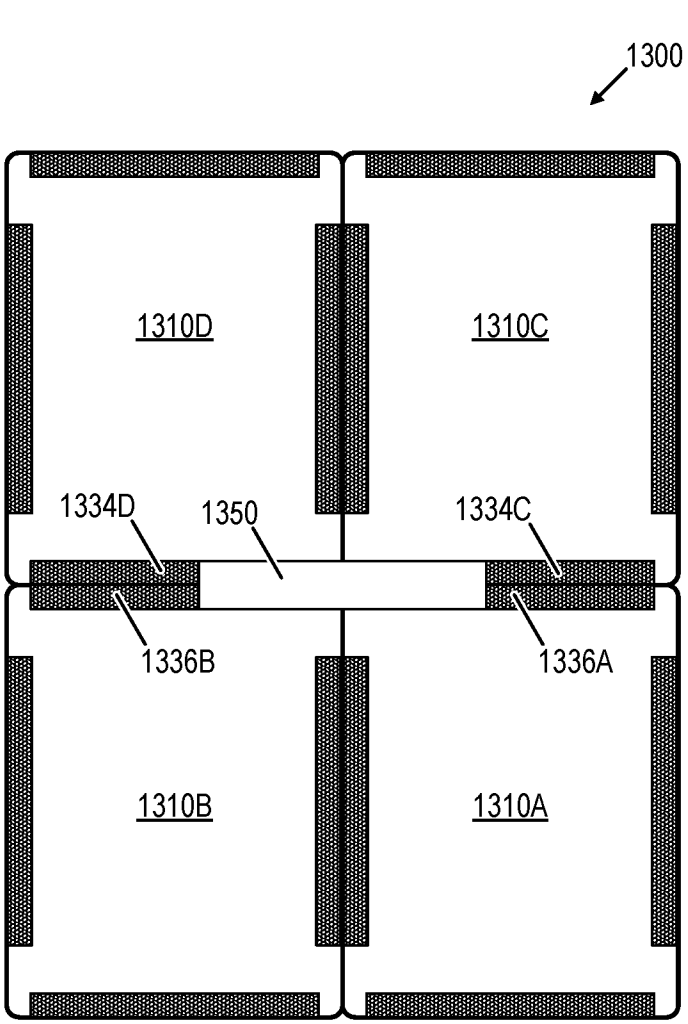

FIG. 13 shows another example modular protective pad system 1300 consistent with the present disclosure. In this example, modular pad units 1310A, 1310B, 1310C, and 1310D can be secured to each other in a side-by-side configuration similar to FIG. 1A by use of a single removable patch 1350 having a touch fastener that can interface with broad-face touch fasteners (e.g., 1336A, 1336B, 1336C, and 1336D) of each of the four pad units. As previously described with reference to patch 1050-2 of FIG. 10, a length dimension (e.g., 1004) of the removable patches can be of sufficient length to enable the patch to span between non-contiguous touch interfaces of two or four modular pad units.

While the example configurations disclosed herein depict the longer sides of the modular pad units being joined to each other, and the short sides of the modular pad units being joined to each other by a removable patch, in still other examples, a longer side of a modular pad unit can be joined to a shorter side of a modular pad unit by a removable patch either via edge-face touch fasteners or broad-face touch fasteners. For example, two modular pad units could be configured in a "T" shape as viewed orthogonal to their broad faces.

In view of the preceding disclosure, touch fasteners located along the perimeter of broad faces and edge faces of the modular pad units can allow for connectivity to other modular pad units on some or all faces of its three-dimensional volume. Each modular unit can be capable of modular connectivity up to the number of total faces or planar surfaces of the unit. Touch fastener placement allows for unit connectivity that is independent of prior existing connections. Thus, the disclose modular protective pad system provides the ability to connect each modular pad unit at both ends of each of its three axes. By utilization of the touch fasteners and removable patches, each pad is granted 360 degrees of independent modular connectivity at each face or plane surface.

According to an example of the present disclosure, a modular protective pad system comprises: a plurality of modular pad units, wherein each modular pad unit forms a three-dimensional volume having two rectangular broad faces that oppose each other, and a plurality of exterior edge faces that join the two rectangular broad faces to each other along a perimeter of the modular pad unit; wherein a first face of the two rectangular broad faces includes a plurality of broad-face touch fasteners each of which forming a two-dimensional region of the first face along a portion of the perimeter of the modular pad unit; wherein two or more of the plurality of exterior edge faces each include an edge-face touch fastener, wherein the edge-face touch fastener forms a two-dimensional region of that exterior edge face along a portion of the perimeter; and a set of two or more removable patches each including a patch-based touch fastener that forms a two-dimensional region and is configured to selectively engage with any of the broad-face touch fasteners and the edge-face touch fasteners of the plurality of modular pad units; wherein a first linear dimension of the two-dimensional region formed by each of the patch-based touch fasteners is larger than twice a second linear dimension from each broad-face fastener to the perimeter portion along which that broad-face fastener is located. In this or other examples disclosed herein, for each edge-face touch fastener, that edge-face touch fastener at least partially overlaps in a linear dimension with a broad-face touch fastener of the plurality of broad-face touch fasteners along the portion of the perimeter of the modular pad unit along which that broad-face fastener is located. In this or other examples disclosed herein, each edge-face touch fastener is aligned with one of the plurality of broad-face touch fasteners along a portion of the perimeter. In this or other examples disclosed herein, the first linear dimension is the smallest linear dimension of the two-dimensional region formed by the patch-based touch fastener. In this or other examples disclosed herein, the two-dimensional region formed by the patch-based touch fastener has a rectangular shape; and wherein the longest edge of the rectangular shape is equal to a longest edge of the two-dimensional region of each broad-face touch fastener and is equal to a longest edge of the two-dimensional region of each edge-face touch fastener. In this or other examples disclosed herein, the plurality of broad-face touch fasteners includes two broad-face touch fasteners that are along the perimeter on two opposing sides of the first face. In this or other examples disclosed herein, the plurality of broad-face touch fasteners includes three broad-face touch fasteners that are along the perimeter on three of four sides of the first face. In this or other examples disclosed herein, the plurality of broad-face touch fasteners includes four broad-face touch fasteners on each of four sides of the first face. In this or other examples disclosed herein, the edge-face touch fastener is one of a plurality of edge-face touch fasteners that each forms a two-dimensional region along the perimeter of one of the plurality of exterior edge faces; and wherein each of the plurality of exterior edge faces includes a respective one of the plurality of edge-face touch fastener. In this or other examples disclosed herein, each edge-face touch fastener is aligned with one of the plurality of broad-face touch fasteners along a portion of the perimeter. In this or other examples disclosed herein, the plurality of modular pad units are configurable in a side-by-side configuration in which the removable patches join at least one broad-face touch fastener of each modular pad unit to at least one other broad-face touch fastener of at least one other modular pad unit of the plurality of modular pad units. In this or other examples disclosed herein, the plurality of modular pad units are configurable in a face-to-face configuration in which the removable pads join one or more edge-face touch fasteners of each modular pad unit to one or more other edge-face touch fasteners of at least one other modular pad unit of the plurality of modular pad units. In this or other examples disclosed herein, each touch fastener is a hook-side or a loop-side of a hook-and-loop fastener.

According to another example of the present disclosure, a modular protective pad system comprises: a modular pad unit forming a three-dimensional volume having two rectangular broad faces that oppose each other, and a plurality of exterior edge faces that join the two rectangular broad faces to each other along a perimeter of the modular pad unit; wherein a first face of the two rectangular broad faces includes a plurality of broad-face touch fasteners each of which forming a two-dimensional region of the first face along a portion of the perimeter of the modular pad unit; wherein the plurality of broad-face touch fasteners includes at least two broad-face touch fasteners located on opposite sides of the first face from each other; wherein two or more of the plurality of exterior edge faces each include an edge-face touch fastener, wherein the edge-face touch fastener forms a two-dimensional region of that exterior edge face along a portion of the perimeter; and wherein the edge-face touch fasteners include at least two edge-face touch fasteners located on opposite sides of the first face from each other. In this or other examples disclosed herein, the system further comprises a set of one or more removable patches each including a patch-based touch fastener that forms a two-dimensional region and is configured to selectively engage with any of the broad-face touch fasteners and the edge-face touch fasteners of the modular pad unit. In this or other examples disclosed herein, each touch fastener is a hook-side or a loop-side of a hook-and-loop fastener. In this or other examples disclosed herein, a first linear dimension of the two-dimensional region formed by each of the patch-based touch fasteners is larger than twice a second linear dimension from each broad-face fastener to the perimeter portion along which that broad-face fastener is located. In this or other examples disclosed herein, for each edge-face touch fastener, that edge-face touch fastener at least partially overlaps in a linear dimension with a broad-face touch fastener of the plurality of broad-face touch fasteners along the portion of the perimeter of the modular pad unit along which that broad-face fastener is located. In this or other examples disclosed herein, each edge-face touch fastener is aligned with one of the plurality of broad-face touch fasteners along a portion of the perimeter. In this or other examples disclosed herein, each edge-face touch fastener is approximately twice as wide as each broad-face touch fastener.

It will be understood that the configurations and/or approaches described herein are exemplary in nature, and that these specific embodiments or examples are not to be considered in a limiting sense, because numerous variations are possible. The claimed subject matter is not limited to implementations that solve any or all problems or disadvantages noted in any part of this disclosure The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A modular protective pad system, comprising:

a plurality of modular pad units, wherein each modular pad unit forms a three-dimensional volume having two rectangular broad faces that oppose each other, and a plurality of exterior edge faces that join the two rectangular broad faces to each other along a perimeter of the modular pad unit;

wherein a first face of the two rectangular broad faces includes a plurality of broad-face touch fasteners each of which forming a two-dimensional region of the first face along a portion of the perimeter of the modular pad unit;

wherein two or more of the plurality of exterior edge faces each include an edge-face touch fastener, wherein the edge-face touch fastener forms a two-dimensional region of that exterior edge face along a portion of the perimeter; and a set of two or more removable patches each including a patch-based touch fastener that forms a two-dimensional region and is configured to selectively engage with any of the broad-face touch fasteners and the edge-face touch fasteners of the plurality of modular pad units;

wherein a first linear dimension of the two-dimensional region formed by each of the patch-based touch fasteners is larger than twice a second linear dimension from each broad-face fastener to the perimeter portion along which that broad-face fastener is located;

wherein the two-dimensional region formed by the patch-based touch fastener has a rectangular shape; and wherein a longest edge of the rectangular shape is equal to a longest edge of the two-dimensional region of each broad-face touch fastener and is equal to a longest edge of the two-dimensional region of each edge-face touch fastener.

2. The system of claim 1, wherein the edge-face touch fastener is one of a plurality of edge-face touch fasteners that each forms a two-dimensional region along the perimeter of one of the plurality of exterior edge faces; and wherein each of the plurality of exterior edge faces includes a respective one of the plurality of edge-face touch fastener.

3. The system of claim 2, wherein each edge-face touch fastener is aligned with one of the plurality of broad-face touch fasteners along the portion of the perimeter.

4. The system of claim 1, wherein for each edge-face touch fastener, that edge-face touch fastener at least partially overlaps in a linear dimension with a broad-face touch fastener of the plurality of broad-face touch fasteners along the portion of the perimeter of the modular pad unit along which that broad-face fastener is located.

5. The system of claim 1, wherein each edge-face touch fastener is aligned with one of the plurality of broad-face touch fasteners along the portion of the perimeter.

6. The system of claim 1, wherein the first linear dimension is the smallest linear dimension of the two-dimensional region formed by the patch-based touch fastener.

7. The system of claim 1, wherein the plurality of broad-face touch fasteners includes two broad-face touch fasteners that are along the perimeter on two opposing sides of the first face.

8. The system of claim 1, wherein the plurality of broad-face touch fasteners includes three broad-face touch fasteners that are along the perimeter on three of four sides of the first face.

9. The system of claim 1, wherein the plurality of broad-face touch fasteners includes four broad-face touch fasteners on each of four sides of the first face.

10. The system of claim 1, wherein the plurality of modular pad units are configurable in a side-by-side configuration in which the removable patches join at least one broad-face touch fastener of each modular pad unit to at least one other broad-face touch fastener of at least one other modular pad unit of the plurality of modular pad units.

11. The system of claim 1, wherein the plurality of modular pad units are configurable in a face-to-face configuration in which the removable pads join one or more edge-face touch fasteners of each modular pad unit to one or more other edge-face touch fasteners of at least one other modular pad unit of the plurality of modular pad units.

12. The system of claim 1, wherein each touch fastener is a hook-side or a loop-side of a hook-and-loop fastener.

13. The modular protective pad system of claim 1, wherein all of the plurality of broad-face touch fasteners and all of the edge-face touch fasteners of the plurality of exterior edge faces include a first type of a hook-side or a loop-side of a hook-and-loop fastener; and wherein all of the patch-based touch fasteners of the set of two or more removable patches include a second type of the hook-side or the loop-side of the hook-and-loop fastener that differs from the first type.

14. A modular protective pad system, comprising:

a modular pad unit forming a three-dimensional volume having two rectangular broad faces that oppose each other, and a plurality of exterior edge faces that join the two rectangular broad faces to each other along a perimeter of the modular pad unit;

wherein a first face of the two rectangular broad faces includes a plurality of broad-face touch fasteners each of which forming a two-dimensional region of the first face along a portion of the perimeter of the modular pad unit;

wherein the plurality of broad-face touch fasteners includes at least two broad-face touch fasteners located on opposite sides of the first face from each other;

wherein two or more of the plurality of exterior edge faces each include an edge-face touch fastener, wherein the edge-face touch fastener forms a two-dimensional region of that exterior edge face along a portion of the perimeter;

wherein the edge-face touch fasteners include at least two edge-face touch fasteners located on opposite sides of the first face from each other; and wherein each edge-face touch fastener is approximately twice as wide as each broad-face touch fastener.

15. The system of claim 14, further comprising:

a set of one or more removable patches each including a patch-based touch fastener that forms a two-dimensional region and is configured to selectively engage with any of the broad-face touch fasteners and the edge-face touch fasteners of the modular pad unit.

16. The system of claim 15, wherein each touch fastener is a hook-side or a loop-side of a hook-and-loop fastener.

17. The system of claim 15, wherein a first linear dimension of the two-dimensional region formed by each of the patch-based touch fasteners is larger than twice a second linear dimension from each broad-face fastener to the perimeter portion along which that broad-face fastener is located.

18. The system of claim 14, wherein for each edge-face touch fastener, that edge-face touch fastener at least partially overlaps in a linear dimension with a broad-face touch fastener of the plurality of broad-face touch fasteners along the portion of the perimeter of the modular pad unit along which that broad-face fastener is located.

19. The system of claim 14, wherein each edge-face touch fastener is aligned with one of the plurality of broad-face touch fasteners along the portion of the perimeter.

20. A modular protective pad system, comprising:

a modular pad unit forming a three-dimensional volume having two rectangular broad faces that oppose each other, and a plurality of exterior edge faces that join the two rectangular broad faces to each other along a perimeter of the modular pad unit; wherein a first face of the two rectangular broad faces includes a plurality of broad-face touch fasteners each of which forming a two-dimensional region of the first face along a portion of the perimeter of the modular pad unit;

wherein the plurality of broad-face touch fasteners includes at least two broad-face touch fasteners located on opposite sides of the first face from each other;

wherein two or more of the plurality of exterior edge faces each include an edge-face touch fastener, wherein the edge-face touch fastener forms a two-dimensional region of that exterior edge face along a portion of the perimeter;

wherein the edge-face touch fasteners include at least two edge-face touch fasteners located on opposite sides of the first face from each other;

wherein for each edge-face touch fastener, that edge-face touch fastener at least partially overlaps in a linear dimension with a broad-face touch fastener of the plurality of broad-face touch fasteners along the portion of the perimeter of the modular pad unit along which that broad-face fastener is located;

a set of one or more removable patches each including a patch-based touch fastener that forms a two-dimensional region and is configured to selectively engage with any of the broad-face touch fasteners and the edge-face touch fasteners of the modular pad unit;

wherein all of the plurality of broad-face touch fasteners and all of the edge-face touch fasteners of the plurality of exterior edge faces include a first type of a hook-side or a loop-side of a hook-and-loop fastener; and wherein all of the patch-based touch fasteners of the set of one or more removable patches include a second type of the hook-side or the loop-side of the hook-and-loop fastener that differs from the first type.

* * * * *